United States Patent [19]

Specht

[11] 4,229,277

[45] Oct. 21, 1980

[54] GLOVE-LIKE DIAPHRAGM STRUCTURE FOR ELECTROLYTIC CELLS

[75] Inventor: Steven J. Specht, Mentor, Ohio

[73] Assignee: Olin Corporation, New Haven, Conn.

[21] Appl. No.: 71,204

[22] Filed: Aug. 30, 1979

[51] Int. Cl.[3] ..... C25B 13/02; C25B 13/08

[52] U.S. Cl. ..... 204/252; 204/282; 204/296

[58] Field of Search ..... 204/252–258, 204/263–266, 295–296, 282–283

[56] References Cited

U.S. PATENT DOCUMENTS

| | | | |
|---|---|---|---|
| 2,104,812 | 1/1938 | Phillips | 204/283 |
| 4,078,987 | 3/1978 | Specht | 204/252 X |
| 4,110,191 | 8/1978 | Specht et al. | 204/295 X |
| 4,152,225 | 5/1979 | Woodward, Jr. et al. | 204/252 X |
| 4,165,272 | 8/1979 | Cunningham | 204/252 X |
| 4,175,024 | 11/1979 | Darlington | 204/295 X |

*Primary Examiner*—Howard S. Williams
*Assistant Examiner*—D. R. Valentine
*Attorney, Agent, or Firm*—Bruce E. Burdick; Thomas P. O'Day

[57] ABSTRACT

A non-adherent glove-like diaphragm structure for use in an electrolysis cell. The diaphragm structure has a finger means with an open upper end, and closed lower end, and a middle section connecting the upper and lower end. The lower end is perforated so as to receive an anode riser therethrough. The diaphragm structure also includes a border for attaching the finger to the upper edge of the cathode so as to separate the cathode from the anode and the anolyte of the electrolytic cell.

20 Claims, 7 Drawing Figures

GLOVE-LIKE DIAPHRAGM STRUCTURE FOR ELECTROLYTIC CELLS

This invention relates to synthetic diaphragm structures for electrolytic cells and particularly to a non-adherent, glove-like diaphragm structure for such cells.

Concern about the health hazards of asbestos diaphragms has resulted in the development of synthetic substitutes which can be used in diaphragm-type electrolytic cells. This development has resulted in the availability of several commercially produced, ion exchange, diaphragm materials which are manufactured in the form of flat sheets. All new commercial installations using such synthetic diaphragms or membranes incorporate filter-press cells because of the simplicity of installing the separator.

There are, however, large numbers of electrolytic cells presently in operation using asbestos diaphragms, such as, for example, the Hooker H-4 cell disclosed in U.S. Pat. No. 3,904,504, by Ruthel et al., issued Sept. 9, 1975, to Hooker Chemicals and Plastics Corporation. It is desirable to be able to convert these cells from asbestos diaphragms to synthetic diaphragms or membranes to reduce the health hazard from asbestos, and to protect the environment from asbestos contamination. One solution would be the replacement of existing diaphragm cells with new filter-press type synthetic diaphragm or membrane cells. This alternative is not economically viable for most manufacturing situations. The other alternative is to somehow modify existing diaphragm cells so that they will be able to use synthetic diaphragms or membranes.

One proposed method of converting a diaphragm electrolytic cell to a membrane electrolytic cell is that of U.S. Pat. No. 4,112,149, by Babinsky, issued Sept. 5, 1978, to Diamond Shamrock Corporation. The Babinsky patent suggests forming a membrane on a standard diaphragm cell cathode by suspending a matting material in a liquid medium and then vacuum-depositing the matting material over the surface of the cathode and then coating the vacuum-deposited matting material with a layer of thermoplastic cation exchange material. The thermoplastic material is then fused into a thin and uniform film on the surface of the matting material by baking the cathode in an oven. The baked thermoplastic layer can be hydrolyzed if necessary to change the thermoplastic form into a cation exchange form. However, that method utilizes asbestos fibers as the matting material, and thus suffers from the very environmental drawbacks which conventional asbestos diaphragm exhibit.

These problems are solved by the present invention, which provides a non-adherent, glove-like diaphragm structure for use in an electrolysis cell of the type having an anolyte, a catholyte, a grate-like cathode structure with an upper edge, a cell base supporting said cathode structure, at least one anode riser attached to said cell base, at least one anode attached to said anode risers and passing upwardly through said cathode structure and a cell top for closing the top of the cell, said diaphragm structure comprising the following parts:

(a) at least one finger means, having an open upper end, a closed lower end and a middle section connecting said upper and lower ends, for passing downwardly through said grate-like cathode structure and loosely around and under said anode so as to separate said anode from said cathode structure, said finger means having portions defining at least one opening in the lower end thereof through which said anode risers can sealingly pass; and (b) border means, sealingly attached to said upper end of said finger means, for passing between said cell top and said upper edge of said cathode structure so as to separate said upper edge of said cathode from said anode and said anolyte.

The invention also provides a method of assembling a diaphragm electrolysis cell of the type having a cell base, a cell top, a grate-like cathode structure having a plurality of vertical cathode fingers, a plurality of vertical anodes rising through said cathode structure, a plurality of flanged anodes posts connecting said anodes to said cell base, said anodes posts passing into holes in said base and a diaphragm between said cathode structure and said anodes, which method comprises the steps of:

(a) fabricating a non-adherent diaphragm structure having holes therein for said anode posts;

(b) placing an insulating seal on said cell base;

(c) placing said grate-like cathode structure on said seal and insulatingly fastening said cell base to said cathode structure;

(d) loosely inserting a non-adherent diaphragm structure into openings in said grate-like cathode structure;

(e) aligning the holes in the diaphragm structure with the holes in the cell base;

(f) placing said anodes between said vertical cathode fingers;

(g) inserting said anode posts through the aligned holes of said diaphragm and into said holes of said cell base, (h) tightening said anode posts to simultaneously secure said anodes and press said flange against the portions of said diaphragm structure surrounding said holes of said diaphragm structure against said cell base, (i) placing a sealing means between said cathode structure and cell top;

(j) folding portions of said diaphragm structure into said sealing means; and (k) comprising a border portion of said diaphragm structure between said cell top and said cathode structure so as to complete the separation of said cathode structure from said anodes and cell base.

The objects and advantages of the present invention will be better understood by reference to the attached drawing, in which.

Figure 5:
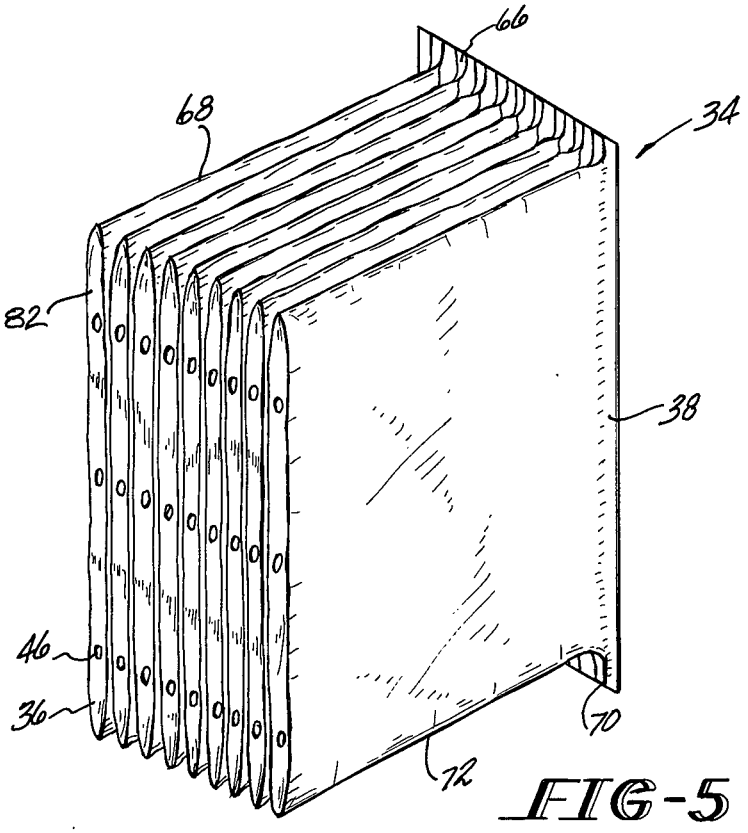
Figure 6:
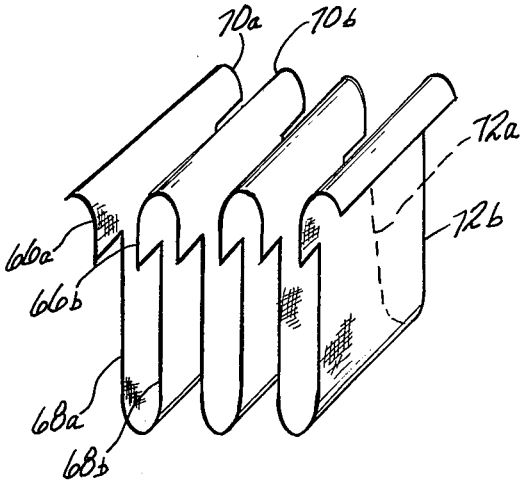
Figure 7:
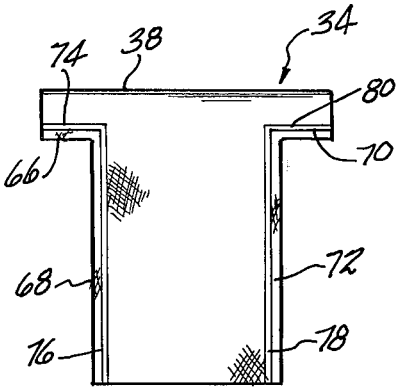

FIG. 5 is an isometric view of the diaphragm structure of the invention, showing the folded tabs and anode riser openings which can be provided therein, FIG. 6 is an isometric view of a folded diaphragm sheet immediately prior to being sealed together to form a diaphragm structure of the invention; and FIG. 7 is a front elevational view of the diaphragm sheet of FIG. 6 after sealing showing where the seals are made.

Figure 1:
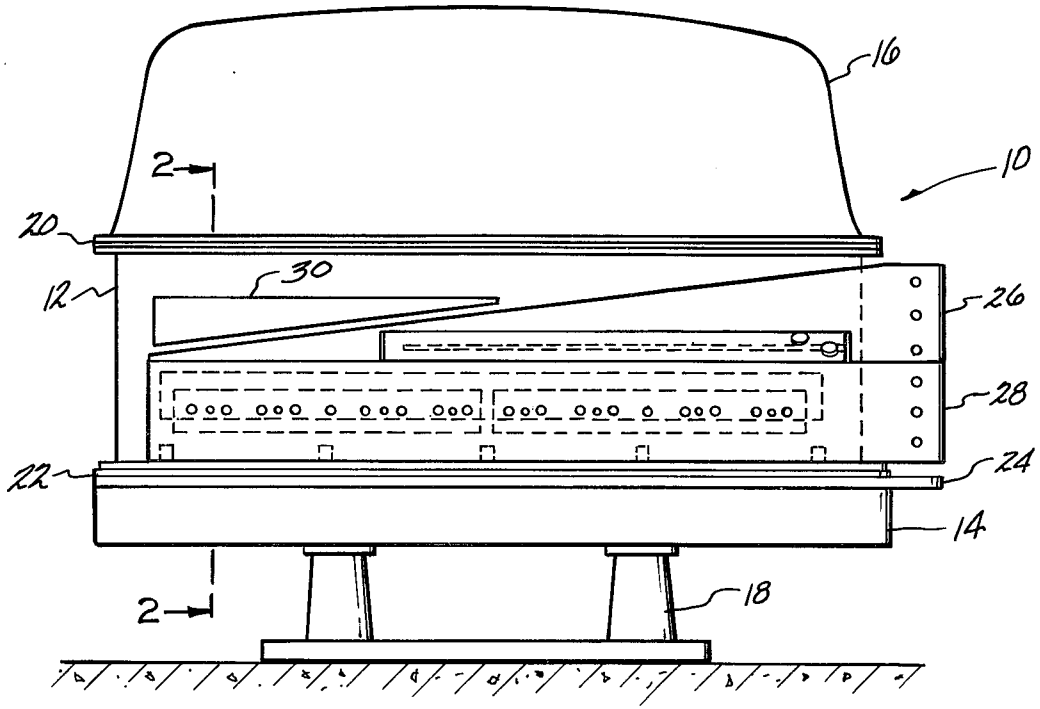
PRIOR ART FIG-1
FIG. 1 is a side elevational view of a typical diaphragm cell in which the invention can be used.

FIG. 1 is an external, side, elevational view of a conventional electrolytic, chlor-alkali cell 10 in which the invention may be utilized. Cell 10 comprises a grate-like cathode structure 12 supported on a cell base 14 and covered by a cell top 16. Cell base 14 can be in turn supported by a double pedestal-type support 18, which in turn rests on the floor of a typical chloralkali plant. A suitable gasket means 20 is provided between cell top 16 and cathode structure 12. Similarly, a suitable gasket 22 is placed between cathode structure 12 and cell base 14. Also lying between cathode structure 12 and cell base 14 is an anode busbar structure 24 which serves to conduct current to the anodes 32 (see FIG. 4) of cell 10. Gasket 22 would therefore preferably lie between busbar 24 and cathode structure 12 so as to insulate them from each other. Cathode structure 12 is preferably provided with cathode busbars 26, 28, and 30 which can be specially designed so as to more uniformly distribute current within cathode structure 12. From all external appearances, the structure of cell 10 appears to be conventional, and therefore FIG. 1 is labeled "prior art" even though it is unconventional inside.

Figure 2:
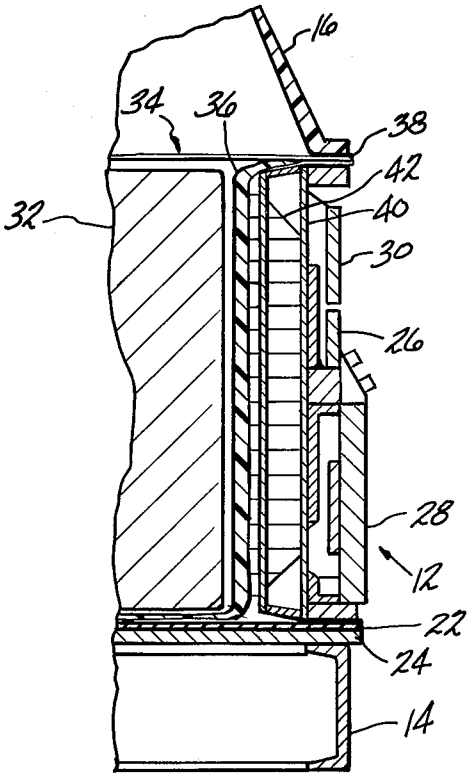
FIG. 2 is a vertical, cross-sectional view, taken along lines 2—2 of FIG. 1 along the center line of an anode thereof, showing the diaphragm structure of the invention.

In order to show the diaphragm structure of the invention as it appears within cell 10, reference should be made to FIG. 2, which is a cross-sectional view taken longitudinally along the vertical center line of an anode 32 of cell 10. The reference numerals in each of the FIGURES of the drawing are intended to refer to the same structures unless otherwise indicated. The interior of cathode structure 12 is surrounded by the diaphragm structure 34 of the invention. Diaphragm structure 34, which as best seen in FIG. 5, as described below.

Figure 4:
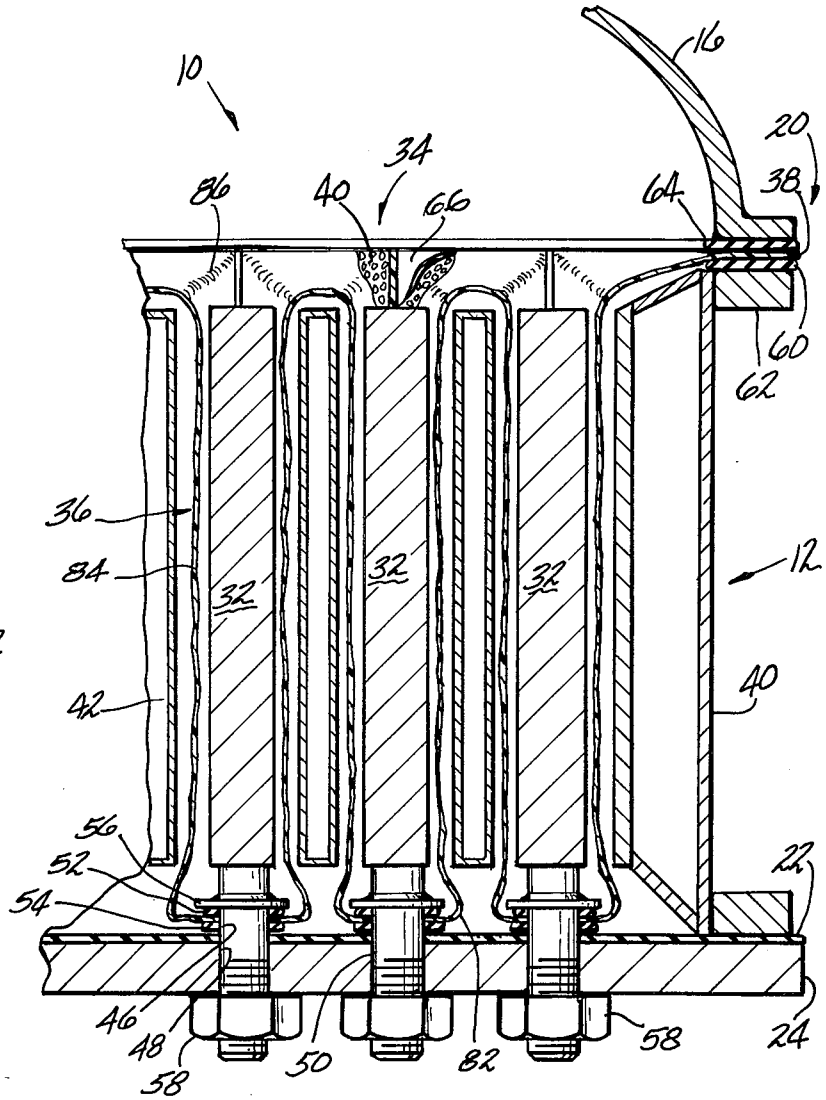
FIG. 4 is a vertical, cross-sectional view taken along lines 4—4 of FIG. 3 showing the placement of the diaphragm structure of the invention in an otherwise conventional electrolytic cell.
Figure 3:
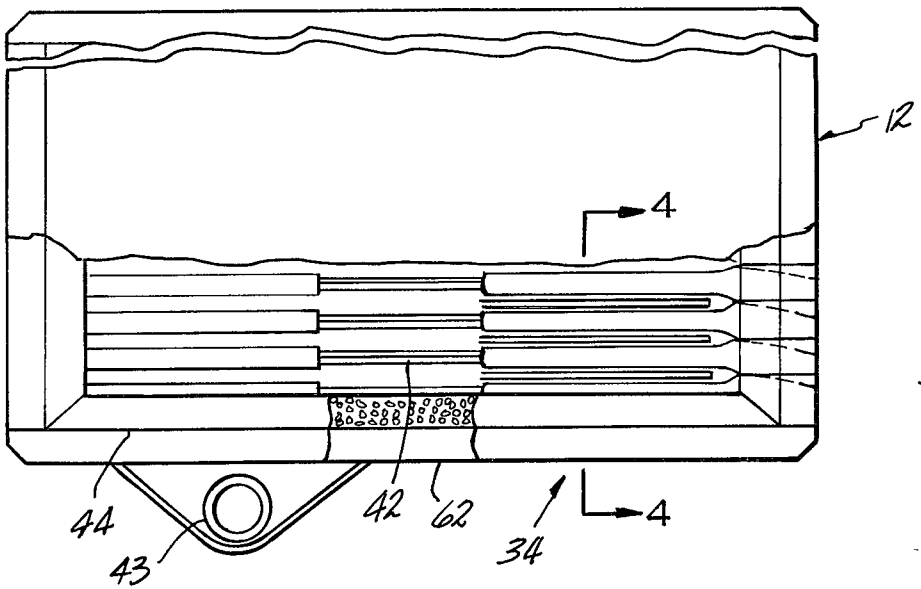
FIG. 3 is a plan view of the diaphragm structure of the invention in place on the cathode of the cell of FIG. 1.

Referring again to FIG. 2, diaphragm structure 34 includes a finger means 36 and a border means 38. Finger means 36 surrounds anodes 32 while border means 38 is for passing between cell top 16 and cathode structure 12 so as to separate the cathode structure 12 from anode 32 and the anolyte (not shown) in contact with anodes 32. The configuration of cathode structure 12 is shown in some detail in FIG. 2. The basic element of structure 12 is the hollow, trapezoidal peripheral flow channel 40, which is best seen in FIG. 4, and cathode fingers 42, which are best seen in FIGS. 3 and 4. Channel 40 serves to direct caustic product to a caustic outlet (not shown) and hydrogen gas to a hydrogen gas outlet 43, best seen in FIG. 3.

FIG. 3 is a plan view showing for purposes of illustration both a conventional adherent-type diaphragm 44 at the lower left of FIG. 3 and the diaphragm structure 34 of the present invention at the lower right of FIG. 3. In actual practice of the invention diaphragm 44 is completely replaced by structure 34. Cathode structure 12 is grate-like, comprising peripheral flow channel 40 and transverse, parallel, spaced cathode fingers 42. In order for diaphragm structure 34 to fit into and surround cathode fingers 42, it is necessary that diaphragm structure 34 have a rather complex shape. The ability to manufacture such a complex shape is now available with the discovery, not forming a part of this invention, that the cation exchange form of the cation exchange materials can be successfully heat sealed without destroying the ion exchange properties of the membrane. Prior art adherent diaphragm 44 was customarily applied by vacuum depositing a slurry upon the flow channel 40 and transverse fingers 42 of cathode structure 12 a suitable diaphragm material and then baking the diaphragm in order to dry the diaphragm material onto the cathode structure 12. The obvious solution to the need for a means of converting from a diaphragm material to a cation exchange membrane material would be to make a slurry of cation exchange material and bake that material onto the conventional diaphragm. However, cation exchange materials are not presently commercially available in a form suitable for generation of slurrys for the cation exchange sheet materials which are available must be modified so as to fit cathode structure 12.

The vertical cross-sectional view of FIG. 4 illustrates how this dilemma can be solved by use of the present invention. First, a diaphragm structure such as later described in FIG. 5 is fabricated as described below and then installed in cell 10. Specifically, once the glove-like structure has been fabricated, a rubber liner or gasket 22 is placed on busbar 24, which in turn rests on cell base 14. Cathode structure 12 is then placed on the cell base and diaphragm structure 34 is installed over the flow channel 40 and transverse fingers 42 of cathode structure 12 with perforations 46 aligned with holes 48 in busbar 24. Anodes 32 are then placed between adjacent cathode fingers 42 and between cathode fingers 42 and flow channel 40. Anode posts 50 of anodes 32 are inserted through perforations 46 and holes 48. A gasket 52 and a gasket 54 can be provided above and below perforation 46 and anode post 50 has a flange 56 which is adapted to compress gaskets 52 and 54 sealingly about perforations 46 upon the tightening of anode post 50 within busbar 24. This tightening is accomplished by use of some suitable tightening means such as threaded nuts 58. After anode post 50 has been tightened so as to seal perforation 46, a gasket 60 is placed over the top flange of cathode structure 12 and tabs 66 of diaphragm structure 34 are folded over gasket 60. Another gasket 64, which can be identical to gasket 60, is placed over the folded tab 66 and cell top 16 is placed atop cathode structure 12 and secured with springs not shown to compress gaskets 60 and 64 against tab 66 so as to seal the diaphragm at cathode flange 62.

FIG. 5 shows an isometric view of diaphragm structure 34, which is rotated 90° from its normal position in order to better show the lower ends 82 of finger means 36. Structure 34 is seen to be a glove-like structure with a border means 38 from which a plurality of finger means 36 downwardly extend, the finger means downwardly terminating at a closed lower end 82 which is perforated with a number of perforations 46. The number of perforations 46 per finger means 36 is determined by the number of anode posts 50 per anode 32. The perforations 46 are preferably made in a diaphragm sheet prior to the folding and sealing operations of FIGS. 6 and 7.

The fabrication of diaphragm structure 34 is best understood by reference to FIGS. 6 and 7 which show, respectively, the folding and sealing of tab portion 66*a*, 66*b* and edge portion 68*a* and 68*b* of a finger means 36 of diaphragm structure 34. After perforation to provide perforations 46, a long sheet of cation material is doubled back and forth into a plurality of folds which are of sufficient length to fit over transverse cathode fingers 42 and below anodes 32. The bottom portion of each fold is then trimmed so that a folded sheet now has a T-shaped configuration such as seen in FIG. 6. Then edges 68 are sealed to edges 68*b*, tab portion 66*a* is sealed to tab portion 66*b*, tab portions 70*a* to tab portions 70*b*, and edge portion 72*a* to edge portion 72*b* to form sealed edges 66, 68, 70, and 72 as seen in FIGS. 5 and 6. Alternatively, seals 74, 76, 78, and 80 in portion 66, side 68, side 72, and tab portion 70, respectively, can be made prior to trimming diaphragm structure 34 into the T-shaped configuration of FIG. 7.

In operating cell 10, it may be desirable to utilize a spacer between anode 32 and diaphragm structure 34 in order to prevent abrasion of either the surface of diaphragm structure 34 or the surface of anode 32. The surface of anode 32 generally is comprised of a catalytic coating which is susceptible to abrasion by diaphragm structure 34. Such a spacer could be formed in the same shape as diaphragm structure 34 and be placed immediately above the corresponding parts of diaphragm structure 34. For purposes of showing this type of spacer, reference is made to FIGS. 2, 3, and 4 of U.S. Pat. No. 4,115,237, by Woodard Jr. et al. commonly assigned.

Referring again to FIG. 4, it is seen that diaphragm structure 34 is a non-adherent, glove-like structure for use in electrolysis cell 10. Cell 10 would have an anolyte solution surrounding anodes 32 within finger means 36. Cell 10 would also have a catholyte solution lying under diaphragm structure 34 and within and surrounding cathode structure 12 and particularly cathode fingers 42. It is noted that cathode structure 12 is a grate-like cathode structure with an upper edge defined by the top surface of flange 62. Also, it is noted that electrolysis cell 10 is a vertical electrolytic cell with cathode fingers 42 and anodes 32 aligned in parallel. The anodes 32 pass upwardly through cathode structure 12 from the point of their attachment to anode busbar 24 of cell base 14. Diaphragm structure 34 includes the finger means 36 for surrounding the anode and the border means 38 for sealing about the cathode structure. Finger means 36 further includes an open upper end 86, a closed lower end 82, and a middle section 84 connecting upper end 86 with lower end 82. In this manner, finger means 36 passes downwardly through the grate-like cathode structrue 12 and loosely around and under the anodes 32 so as to separate anodes 32 from cathode structure 12, finger means 36 having portions defining at least one opening or "perforation" in lower end 82 through which an anode riser or post 50 can sealingly pass. Gaskets 52 and 54 serve to seal openings or perforations 46 following such passage. Border means 38 of diaphragm structure 34 is sealingly attached to the upper end 86 and passes between cell top 16 and the upper edge or upper surface of flange 62 of cathode structure 12 so as to separate the upper edge of flow channel 40 and the upper edge of flange 62 from anodes 32 and any anolyte within the cell 10. As noted above, finger means 36 can consist essentially of cation exchange membrane sheet material, whether or not border means 38 also consists of cation exchange membrane sheet material. It would be preferable that border means 38 also consist essentially of cation exchange membrane sheet material. Preferably, middle section 84 of finger means 36 is comprised of two planer sheets of synthetic diaphragm material and two linear side flanges or "sides" 68, 72 joining the sides of the two sheets. These edges are called "flanges" because when joined they lie in a plane approximately half way between the plane of each of the sheets forming finger means 36. If desired, a plurality of sheets could be used rather than one single sheet folded back and forth. If a plurality of sheets were used, they could be overlapped together at either lower end 82 or upper end 86. It would be, however, preferable that they be overlapped at lower end 82 in order to have double strength at perforations 46. Another alternative would be to reinforce lower end 82 by an additional separate piece of cation exchange material so as to strengthen perforations 46. The bottom end 82 and middle section of each finger means 36 comprises a single U-shaped sheet looped under the bottom edge of an anode 32 and to linear side flanges or seals 76, 78 joining the sides 68, 72 of the folded sheet. Gasket means 20 can preferably comprise the subelements of a part of border means 38 lying between cell top 16 and flange 62 of cathode structure 12, a gasket 64 which seals between the cell top 16 and border means 38, a gasket 64 which seals between border means 38 and flange 62 and a transition region of synthetic diaphragm material for connecting finger means 36 to border means 38 so as to complete the separation of cathode structure 12 from anodes 32 and any surrounding anolyte within cell 10.

As best seen in FIGS. 5 and 7, diaphragm structure 34 preferably has at least two corners formed by the junction of tab portion 66 and 70, respectively, with sides 68 and 72. Tab portions 66 and 70 are twistable and thus serve as the transition regions, previously mentioned, between finger means 36 and border means 38 at the junction of tabs 66 and 70 with sides 68 and 72. Tab portion 66 and 70 adapted to be held in sealed, twisted position against border means 38 and between cell top 16 and flange 62 of cathode structure 12.

Seals 68 and 72 are preferably two vertical, linear side seals along opposite sides 68 and 72 of finger means 36. Seals 74 and 80 are preferably lateral linear seals at an angle to seal 76 and 78. Seals 74 and 80 are adapted to be twisted into a twisted position lying partially against border means 38. It is preferred that seals 74, 76, 78, and 80 be heat sealed.

The anode is preferably an insoluble electrode such as platinum group metal, titanium coated with a platinum group metal, or titanium coated with a platinum group metal oxide. The cathode is preferably made of iron, stainless steel, or nickel. The shape of the electrodes can be flat perforated plate, flat mesh, louvered plate, louvered mesh or other suitable shape which exhibits satisfactory gas release. The diaphragms are preferably cation permeable membranes which have oxidation resistance and chlorine resistance and are comprised of a chlorine-resistant polymer type cation-exchange membrane. For example, a copolymer of tetrafluoroethylene and a sulfonated perfluorovinyl ether or a copolymer of tetrafluoroethylene and a carboxylated perfluorovinyl ether and the like. The later cation-exchange membranes are preferably used. Suitable for use as such "carboxylate membranes" are membranes produced by Asahi Glass Company of Japan. Another suitable "carboxylate membrane" is that disclosed in U.S. Pat. No. 4,151,053, by Seko et al, issued Apr. 24, 1979. Such a carboxylate membrane preferably comprises a fluorocarbon polymer which has pendent carboxylic acid groups of the formula—$OCF_2COOH$ and derivatives thereof. Carboxylate membranes have been found to produce about 35% by weight caustic soda aqueous solution at over 90% current efficiency.

An alternative cation exchange membrane is one comprising a fluorocarbon polymer characterized by the presence of pendent sulfonic acid groups of the formula—$OCF_2SO_3H$ and derivatives thereof. This "sulfonic acid" membrane has been found to produce approximately 25% caustic soda aqueous solution at about 75%–80% current efficiency. If such a "sulfonic acid" membrane is treated on the caustic side with ethylene diamine to a depth of about 1.5 mils (38 microns) the current efficiency is boosted to about 85%. Therefore, it is apparent that the carboxylate membrane is presently superior to the sulfonic acid type membrane for chloralkali cells.

It will be understood that gasket 22 also serves to electrically insulate busbar 24 from cathode structure 12. Gasket 22 may take the form of a rubber sheet which covers the entire upper surface of busbar 24 and has perforations therethrough lined up with holes 48 in busbar 24. If gasket 22 is in such a sheet-like form, gaskets 54 could be eliminated and the diaphragm instead seals directly against the upper surface of gasket 22 surrounding holes 48. Such a procedure would eliminate the need to align gaskets 54 with holes 48 prior to placing the anodes 32 between the vertical cathode fingers 42 and inserting the anode posts through the aligned holes perforation 46 and holes 48. It will also be understood that it is preferable that the upper surface of flange 62 be planer so that the border means 38 of diaphragm structure 34 can be sealed to cathode structure 12 along a planer surface. Another alternative is that perforations 46 can be reinforced by use of inert material rather than cation exchange material since lower end 82 does not have to have ion exchange properties and therefore does not have to be permeable to cations as does middle section 84.

From the above description, together with the various alternatives mentioned, it will be apparent that many alternatives are included within the scope of the invention and the following claims are to be interpreted broadly to include all such equivalence.

What is claimed is:

1. A non-adherent, glove-like diaphragm structure for use in an electrolysis cell of the type having an anolyte, a catholyte, a grate-like cathode structure with a plurality of vertical openings and an upper edge, a cell base supporting said cathode structure from below, a plurality of vertical anode risers attached to said cell base, a plurality of anodes attached to said anode risers and passing upwardly into openings in said cathode structure and a cell top for closing the top of the cell, said diaphragm structure comprising the following parts:

(a) a plurality of interconnected finger means, having an open upper end, a closed lower end and a middle section connecting said upper and lower ends, for passing over and downwardly through said grate-like cathode structure and loosely around and under said anodes so as to separate said anodes from said cathode structure, said finger means having portions defining at least one opening in the lower end thereof through which said anode risers can sealingly pass; and (b) border means, sealingly attached to said upper end of said finger means, for passing between said cell top and said upper edge of said cathode structure so as to separate said upper edge of said cathode from said anodes and said anolyte.

2. The diaphragm structure of claim 1 wherein said finger means consists essentially of cation exchange membrane sheet material.

3. The diaphragm structure of claim 2 wherein said border means consists essentially of cation exchange membrane sheet material.

4. The diaphragm structure of claim 1, wherein said middle section further comprises the subelements of:

(a) Two planar sheets of synthetic diaphragm material; and (b) Two linear sealed side flanges joined the sides of said two sheets.

5. The diaphragm structure of claim 4 wherein said lower end comprises overlapped sealed bottoms of said two sheets.

6. The diaphragm structure of claim 1, wherein said bottom and middle section further comprise the subelements of:

(a) a single U-shaped sheet looped under said bottom of said anode;

(b) two linear sealed side flanges joining the sides of said sheets.

7. The diaphragm structure of claim 1 wherein said border means comprises the subelements of:

sealing section, means, for lying between said cell top and said cathode structure;

first gasket means for sealing between said cell top and said border section and said cell top;

second gasket means for sealing between said border section and said cathode structure; and transition region means of synthetic diaphragm material, for connecting said finger means and said border section means so as to complete the separation of said cathode from said anolyte and anode.

8. The diaphragm structure of claim 7 wherein said upper end of said finger means has at least two corners, and said transition region means comprises at least two twistable tab means, at the junction of said two corners with said border means, for being held in sealed, twisted position against said sealing section and between said cell top and cathode structure.

9. The diaphragm structure of claim 8 wherein:

(a) said finger means includes two planar sheets joined by two vertical, linear side seals along opposite sides thereof; and (b) each of said transition regions includes a lateral linear seal means, at an angle to one of said side seals, for being twisted into a twisted position lying partially against said sealing section.

10. The diaphragm structure of claims 4, 6, or 7 wherein said seals are heat seals.

11. The diaphragm structure of claim 1 wherein said diaphragm finger means is a cation exchange membrane and is comprised of a cation exchange resin material having carboxylic acid moieties as the predominant ion exchange group.

12. The diaphragm structure of claim 1 wherein said diaphragm is a cation exchange membrane comprised of a cation exchange resin material having sulfonamide moieties as the ion exchange group.

13. The diaphragm structure of claim 1 wherein said diaphragm is a cation exchange membrane comprised of a cation exchange resin material having sulfonic acid moieties.

14. A method of assembling a diaphragm electrolysis cell of the type having a cell base, a cell top, a grate-like cathode structure having a plurality of vertical cathode fingers, a plurality of vertical anodes rising through said cathode structure, a plurality of flanged anodes posts connecting said anodes to said cell base, said anode posts passing into holes in said base, and a diaphragm between said cathode structure and said anodes, which method comprises the steps of:

(a) fabricating a non-adherent diaphragm structure having holes therein for said anode posts;
(b) placing an insulating seal on said cell base;
(c) placing said grate-like cathode structure on said seal and insulatingly fastening said cell base to said cathode structure;
(d) loosely inserting a non-adherent diaphragm structure into openings in said grate-like cathode structure;
(e) aligning the holes in the diaphragm structure with the holes in the cell base;
(f) placing said anodes between said vertical cathode fingers;
(g) inserting said anode posts through the aligned holes of said diaphragm and into said holes of said cell base;
(h) tightening said anode posts to simultaneously secure said anodes and press said flange against the portions of said diaphragm structure surrounding said holes of said diaphragm structure against said cell base;
(i) placing a sealing means between said cathode structure and cell top;
(j) folding portions of said diaphragm structure into said sealing means; and
(k) compressing a border portion of said diaphragm structure between said cell top and said cathode structure so as to complete the separation of said cathode structure from said anodes and cell base.

15. The method of claim 14 further comprising the step of:

sealing said diaphragm structure to said cathode structure along a planar surface.

16. The method of claim 14 further comprising the step of:

reinforcing the portions of said diaphragm structure surrounding said holes therein with additional diaphragm material.

17. The method of claim 14 further comprising the step of reinforcing said portions of said diaphragm structure surrounding said holes therein with inert material.

18. The method of claim 14 wherein said diaphragm is made of synthetic cation exchange membrane sheet material.

19. The method of claim 18 wherein the cation exchange material is comprised of a fluorinated copolymer having as the ion exchange group a carboxyl group ending in either an acid an ester or a salt.

20. The method of claim 18 wherein the cation exchange material is comprised of a copolymer of a sulfonated perfluorovinyl ether and tetrafluoroethylene.

* * * * *